US007143621B2

(12) United States Patent
Bruyas et al.

(10) Patent No.: US 7,143,621 B2
(45) Date of Patent: Dec. 5, 2006

(54) GUIDE SUPPORT FOR A TUBE-BENDING MACHINE

(76) Inventors: Jean Paul Bruyas, 378 chemin des Garennes, Charly (FR) F-69390; Jean Paul Chastan, 38 cours des Sources, Ecully (FR) F-69130; Serge Cappello, Chemin de Rosette, Taluyers (FR) F-69440

( * ) Notice: Subject to any disclaimer, the term of this patent is extended or adjusted under 35 U.S.C. 154(b) by 0 days.

(21) Appl. No.: 10/518,359

(22) PCT Filed: Jun. 25, 2003

(86) PCT No.: PCT/FR03/01949

§ 371 (c)(1),
(2), (4) Date: Mar. 18, 2005

(87) PCT Pub. No.: WO04/000479

PCT Pub. Date: Dec. 31, 2003

(65) Prior Publication Data

US 2005/0217337 A1 Oct. 6, 2005

(30) Foreign Application Priority Data

Jun. 25, 2002 (FR) ..... 02 07847

(51) Int. Cl.
*B21D 7/024* (2006.01)

(52) U.S. Cl. ..... 72/157; 72/149

(58) Field of Classification Search ..... 72/157, 72/158, 156, 155, 150, 149
See application file for complete search history.

(56) References Cited

U.S. PATENT DOCUMENTS 4,843,859 A * 7/1989 Togoshi ..... 72/149
5,499,522 A * 3/1996 Schwarze ..... 72/157
6,155,091 A 12/2000 Hayes et al.

FOREIGN PATENT DOCUMENTS

EP 0990471 4/2000

* cited by examiner

*Primary Examiner*—Ed Tolan
*Assistant Examiner*—Debra Wolfe
(74) *Attorney, Agent, or Firm*—Dowell & Dowell, P.C.

(57) ABSTRACT

A guide support for a tube bending machine comprising a base frame, a bending head, a bending arm, a bending roller, a locking jaw, sliding means for the displacement of the bending head in horizontal and vertical directions with respect to the base frame, at least two guides carried on an element and including recesses arranged in opposite directions with respect to the tube, guiding means for the element on the bending head, the guide element being guided in a horizontal translation motion on a plate securely fastened to the bending head, the guiding means being positioned adjacent a first surface of the element, and the at least two guides being arranged parallel to each other adjacent a second, opposite surface of the element. As a result of the guide support, either clockwise or counterclockwise bending can be effectuated on the same tube bending machine.

6 Claims, 10 Drawing Sheets

GUIDE SUPPORT FOR A TUBE-BENDING MACHINE

BACKGROUND OF THE INVENTION

1. Field of the Invention

The present invention relates to a guide support for tube bending machines and, more particularly, to a guide support for tube bending machines that allows the bending of a tube either to the left, in a clockwise direction, or to the right, in a counterclockwise direction.

2. Description of Related Art

To bend a tube in a clockwise direction, a bending arm rotates from the right to the left around a bending head.

To bend a tube in a counterclockwise direction, a bending arm rotates from the left to the right around a bending head.

French patent application No. 0118593, in the name of the applicant, discloses a tube bending machine for bending a tube either to the left or to the right by means of a bending roller mounted to the bending arm.

Further, a tube bending machine described in the French patent application No. 1116593 comprises:

- a stationary framework provided along its longitudinal axis with a guide rail on which slides a movable carriage rigidly secured to a bushing that provides through the action of an internal clamping chuck the guiding and the immobilization of a tube for bending, in either a rotational or in a translational motion;
- at one of its extremities a bending head, a bending roller and a bending arm that rotates around the vertical axis XX' of the bending head for the forming of the tube;
- a bending arm provided with a chuck jaw support that travels horizontally in the direction of the bending head, being said chuck jaw support rigidly secured to a clamping jaw that is provided with at least one jaw for the bending of the tube in a clockwise direction and with at least one jaw for the bending of the tube in a counterclockwise direction, which jaws are stationary with respect to each other;
- a bending roller that is mounted on the bending arm and is provided with at least one jaw for the bending of the tube in a clockwise direction and with at least one jaw for the bending of the tube in a counterclockwise direction, being said jaws laterally staggered with respect to each other, and on side and the other of the vertical axis XX' of the bending head;
- a first guide support that comprises at least one jaw for the tight support of the tube at the time of the bending in a clockwise direction;
- and a second guide support that comprises at least one jaw for the tight support of the tube at the time of the bending in a counterclockwise direction.

As such, the tube bending machine disclosed in French patent application No. 116593 comprises two guide supports to effectuate the bending of the tube in a clockwise and a counterclockwise direction, respectively.

SUMMARY OF THE INVENTION

The guide support in accordance with the present invention provides for the simplification and the replacement of the first and second guide supports by enabling bending to be effectuated in clockwise and counterclockwise directions.

The guide support in accordance with the present invention can be built for and installed on any type of tube bending machine.

The guide support in accordance with the present invention comprises at least two guides whose respective recesses are arranged in opposite directions with respect to the position of a tube for bending and two guiding means for the guides on the bending head.

The guide support in accordance with the present invention comprises an element guided in a horizontal motion on a plate rigidly secured to the bending head. The element includes the guiding means on a first surface and the at least two guides arranged parallel to each other on a second opposite surface.

The guide element in accordance with the present invention further includes parallel rails on the second, opposite surface, each of which each interacts with a guide.

The guide support in accordance with the present invention comprises a first guide that is provided with a partially cylindrical recess having an internal diameter that corresponds to an outer diameter of a tube to be held between jaws of a clamping jaw during bending.

The guide support in accordance with the present invention comprises a second guide provided with a partially cylindrical recess having an internal diameter that corresponds to an outer diameter of a tube to be held between jaws of a clamping jaw during bending.

The guide support in accordance with the present invention is provided with guides that are immobilized on the rails in such a manner that their respective recesses are arranged in opposite directions with respect to a horizontal axis of the tube bending machine, embodied by the tube.

The guide support in accordance with the present invention is provided with guides that enable either a left, or counterclockwise, bending or a right, or clockwise, bending to be effectuated on the same bending machine.

BRIEF DESCRIPTION OF THE SEVERAL VIEWS OF THE DRAWINGS

The below description with respect to the attached illustrations, given by way of example but not limiting, allows a better understanding of the invention, its characteristics and the advantages it is likely to offer.

DETAILED DESCRIPTION OF THE INVENTION

Figure 1:
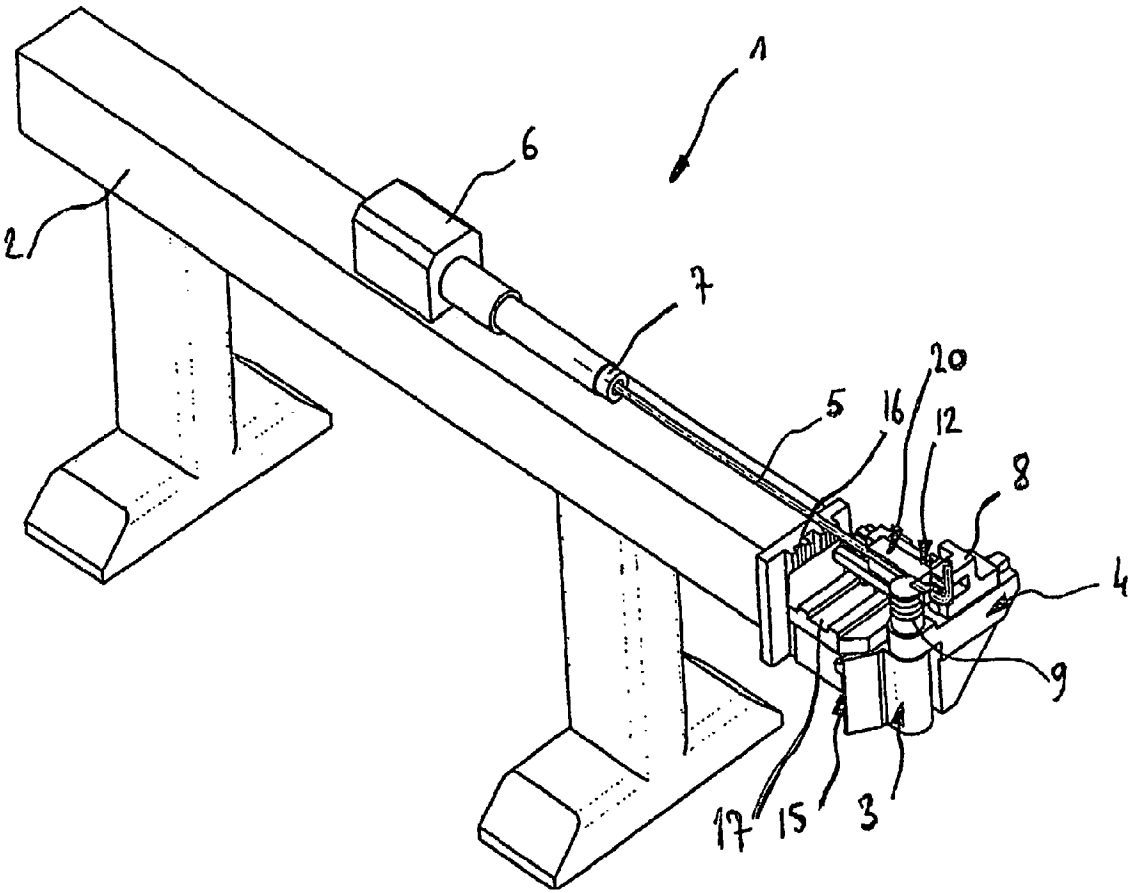
FIG. 1 is a perspective view illustrating a tube bending machine comprising a guide support according to the present invention.
Figure 2:
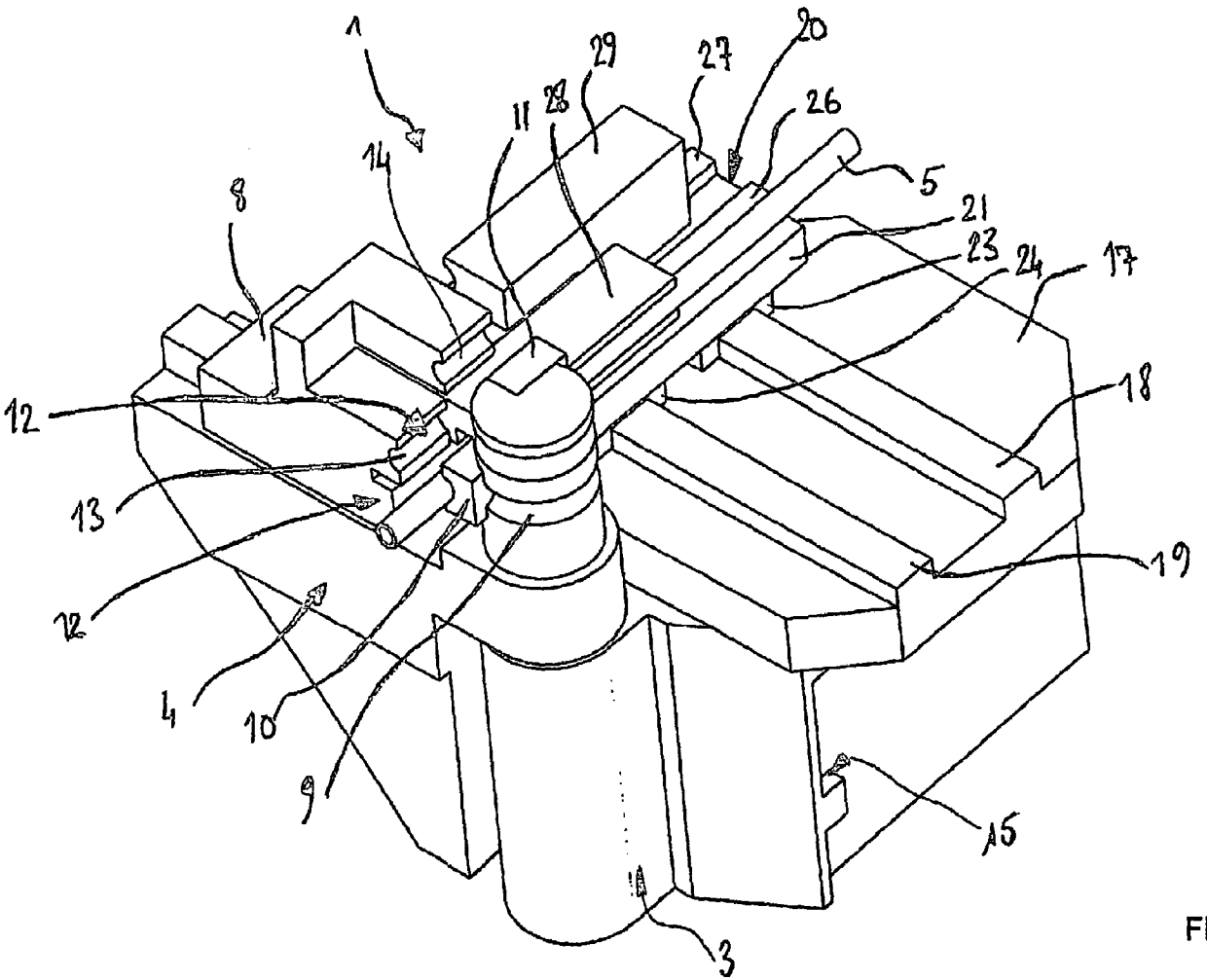
FIG. 2 is perspective view showing in detail the bending head of a tube bending machine provided with the guide support according to the present invention.
Figure 3:
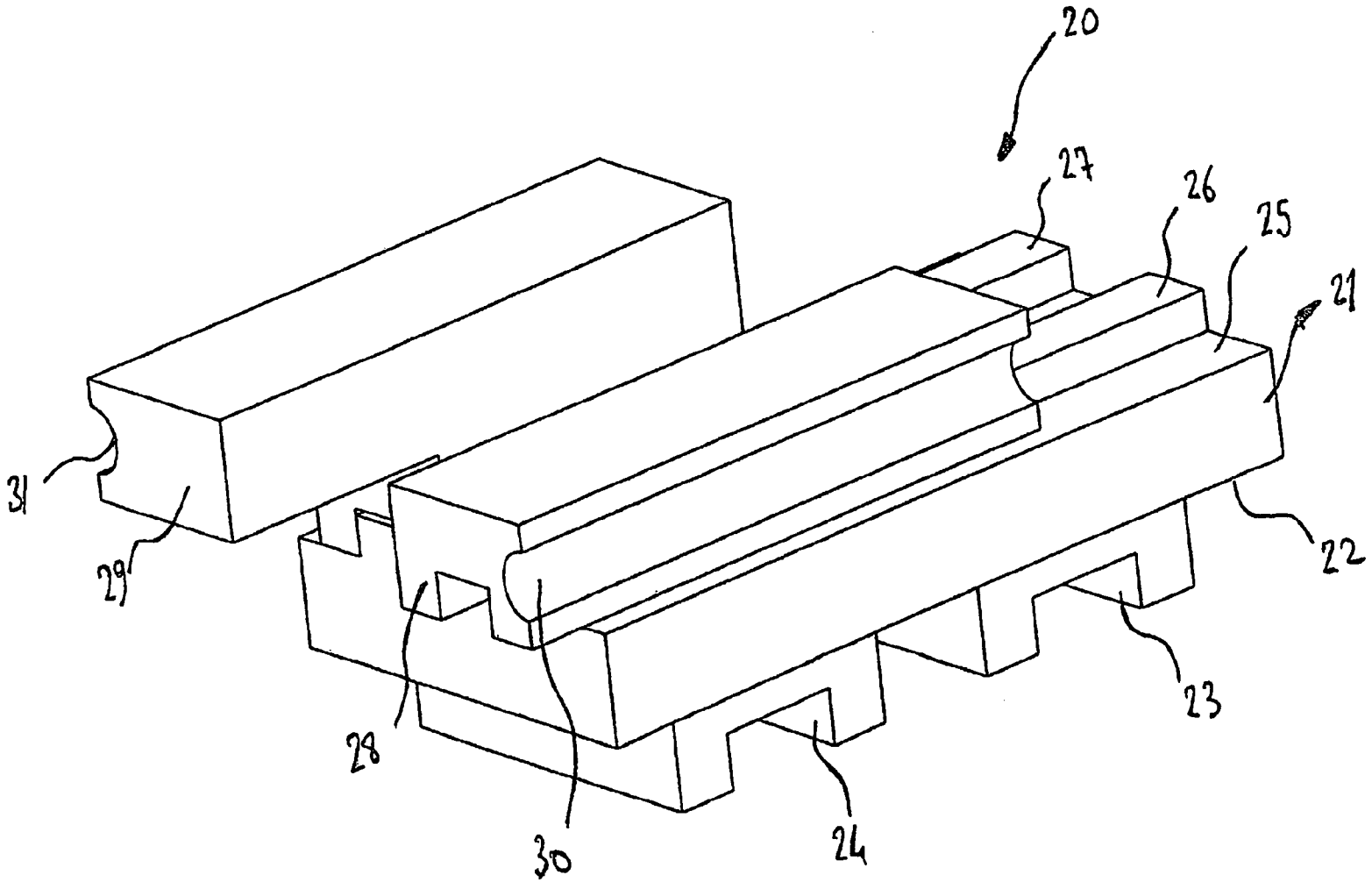
FIG. 3 is a perspective view showing in detail the guide support according to the present invention.

As shown in FIGS. 1 to 3, a bending machine 1 having a stationary framework 2 is provided at one of its ends with a bending head 3, around which rotates a bending arm 4 for forming of a tube 5 in either a clockwise or in a counterclockwise direction.

Opposite the bending head 3 and along its longitudinal axis, the framework 2 comprises a carriage 6 which, depending on the type of the bending machine, can move either toward or away from the bending head 3.

The carriage 6 comprises fastening means 7 for receiving and securing the tube 5 in order to move it horizontally and in a rotational manner around its axis.

The bending arm 4 comprises a grip support 8 that moves horizontally in the direction of the bending head 3.

The bending arm 4 is rigidly secured to a bending roller 9 to provide a fastening device of a clamping jaw 12 provided with at least one jaw 10, 11 of different bending radii.

The clamping jaw 12 is provided on the grip support 8 of the bending arm 4 with at least one jaw 13, 14 for the purpose of interacting with the jaws 10, 11, respectively, of the bending roller 9.

The bending head 3 is provided with sliding means 15, 16 for allowing the bending head 3 to travel in horizontal and vertical directions with respect to the stationary framework 2.

Thus, the sliding means 15 allow the bending head 3 to travel in horizontal directions from the left to the right, and vice versa, with respect to the framework 2.

Likewise, the sliding means 16 allow the bending head 3 to travel in vertical directions from the top downwardly, and vice versa, with respect to the framework 2.

Depending on the programming of the bending machine 1, the jaws 10, 13 and 11, 14 of the clamping jaw 12 can effectuate, by way of example, the bending of the tube 5 according to different curvature radii in a clockwise direction.

Also depending on the programming of the bending machine 1, the jaws 10, 13 and 11, 14 of the clamping jaw 12 can effectuate, by way of example, the bending of the tube 5 according to different curvature radii in a counterclockwise direction.

Lastly, depending on the programming of the bending machine 1, the jaws 10, 13 of the clamping jaw 12 can effectuate the bending of the tube 5 according to a curvature radius in a counterclockwise direction, while the jaws 11, 14 of the clamping jaw 12 effectuate the bending of the tube 5 according to a curvature radius either identical to or different from the one previously formed but in a clockwise direction.

Between the sliding means 15 and 16, the bending head 3 is provided with a horizontal plate 17 comprising parallel guide rails 18, 19 for the sliding of a guide support 20.

The guide support 20 can travel in a horizontal direction in such a manner as to move toward or away from the clamping jaw 12 of the bending machine 1.

The sliding of the guide support 20 in direction toward the clamping jaw 12 is disposed on a horizontal plane that is perpendicular to the sliding means 15 for the horizontal displacements of the bending head 3 with respect to the framework 2 and to the sliding means 16 allowing the vertical displacements of the bending head 3 with respect to the framework 2.

The guide support 20 comprises an element 21 provided on its bottom 22 with guides 23 and 24 for interacting with rails 18 and 19 of the plate 17.

On its upper side 25 and in a perpendicular direction to that of the guides 23, 24, the element 21 of the support guide 20 is provided with parallel rails 26 and 27, each of which interacts with each of the guides 28 and 29, respectively, in order to allow either the sliding or the immobilization of the guides 28 and 29 on the element 21.

The guide 28 comprises a recess 30 that can be partially cylindrical and that has an internal diameter that corresponds to an outer diameter of the tube 5 which, during bending, is held between the jaws of the bending roller 9 and of the clamping jaw 12.

The guide 29 is provided with a recess 31 that can be partially cylindrical and that has an internal diameter that corresponds to an outer diameter of the tube 5 which, during bending, is held between the jaws of the bending roller 9 and the clamping jaw 12.

The profile of the recesses 30, 31 of each guide 28, 29 corresponds to the outer diameter of the tube, which can present any exterior shape.

The guides 28 and 29 interact with the rails 26 and 27 in such a manner that their respective recesses 30 and 31 are arranged in opposite directions with respect to the horizontal axis of the machine 1, embodied by the tube 5.

Thus, the recess 30 of the guide 28 is turned from the side of the bending roller 9, while recess 31 of the guide 29 is oriented in the direction of the clamping jaw 12 when the grip support 8 is positioned at the left of the tube 5.

The number of the guides 28, 29 depends on the number of the jaws 10, 13 and 11, 14 installed on the tube bending machine 1.

The height of the recesses 30 and 31 of the guides 28 and 29, respectively, are staggered with respect to each other due to the position of the jaws 10, 13 and 11, 14 of the clamping jaw 12 on the bending arm 4.

In a preferred embodiment, the guide 28 is applied against the tube 5 when the tube 5 is being bent by the jaws 10, 13 of the clamping jaw 12, while the guide 29 is applied against the tube 5 when the tube 5 is being bent by the jaws 11, 14 of the clamping jaw 12.

Under these conditions, the inverted positions of the guides 28 and 29 allows the same bending machine 1 to effectuate either a bending to the left, or counterclockwise, or a bending to the right, or clockwise, respectively.

Thus, with such a design, the jaws 10, 13 of the clamping jaw 12 and the guide 28 of the guide support 20 allow a bending of the tube 5 in a counterclockwise direction because the bending arm 4 rotates from left to right around the bending head 3.

On the other hand, the jaws 11, 14 of the clamping jaw 12 and the guide 29 of the guide support 20 enable the carrying out of a bending of the tube 5 in a clockwise direction because the bending arm 4 rotates from right to left around the bending head 3.

FIGS. 4 to 7 illustrate the various bending stages of the tube 5 when the bending machine 1 effectuates a bending in a counterclockwise direction.

Figure 4:
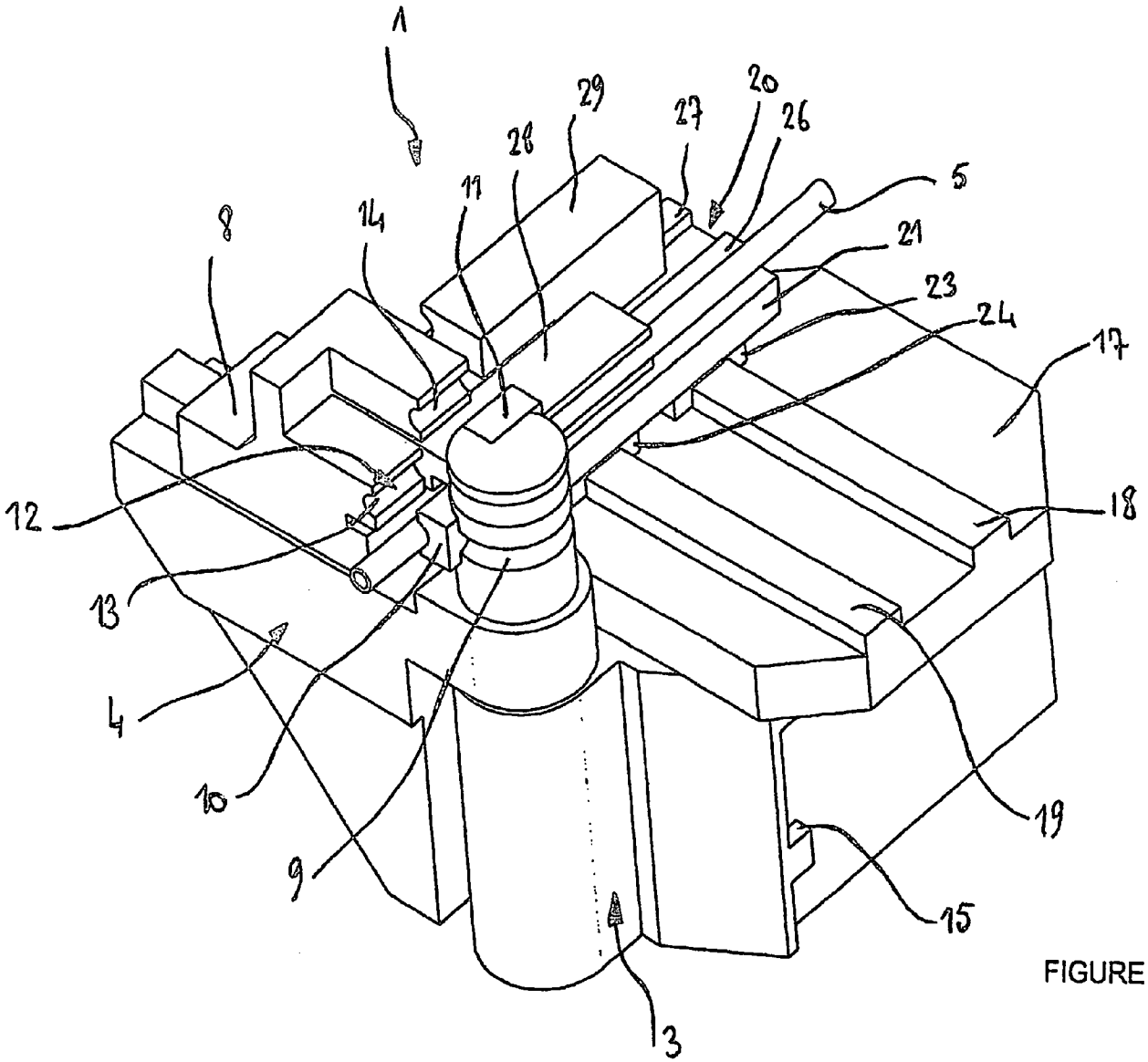
FIGS. 4 to 7 are perspective views showing the different stages of the bending machine in effectuating by means of the guide support, according to the present invention, bending a tube in a counterclockwise direction, where a bending arm rotates from left to right around the bending head.

FIG. 4 shows the position of the tube 5 inside the jaws 10 and 13 of the clamping jaw 12 to effectuate a first bending. The guide 28 of the guide support 20 is in close contact against the tube 5 so that it is lodged in the recess 30.

Figure 5:
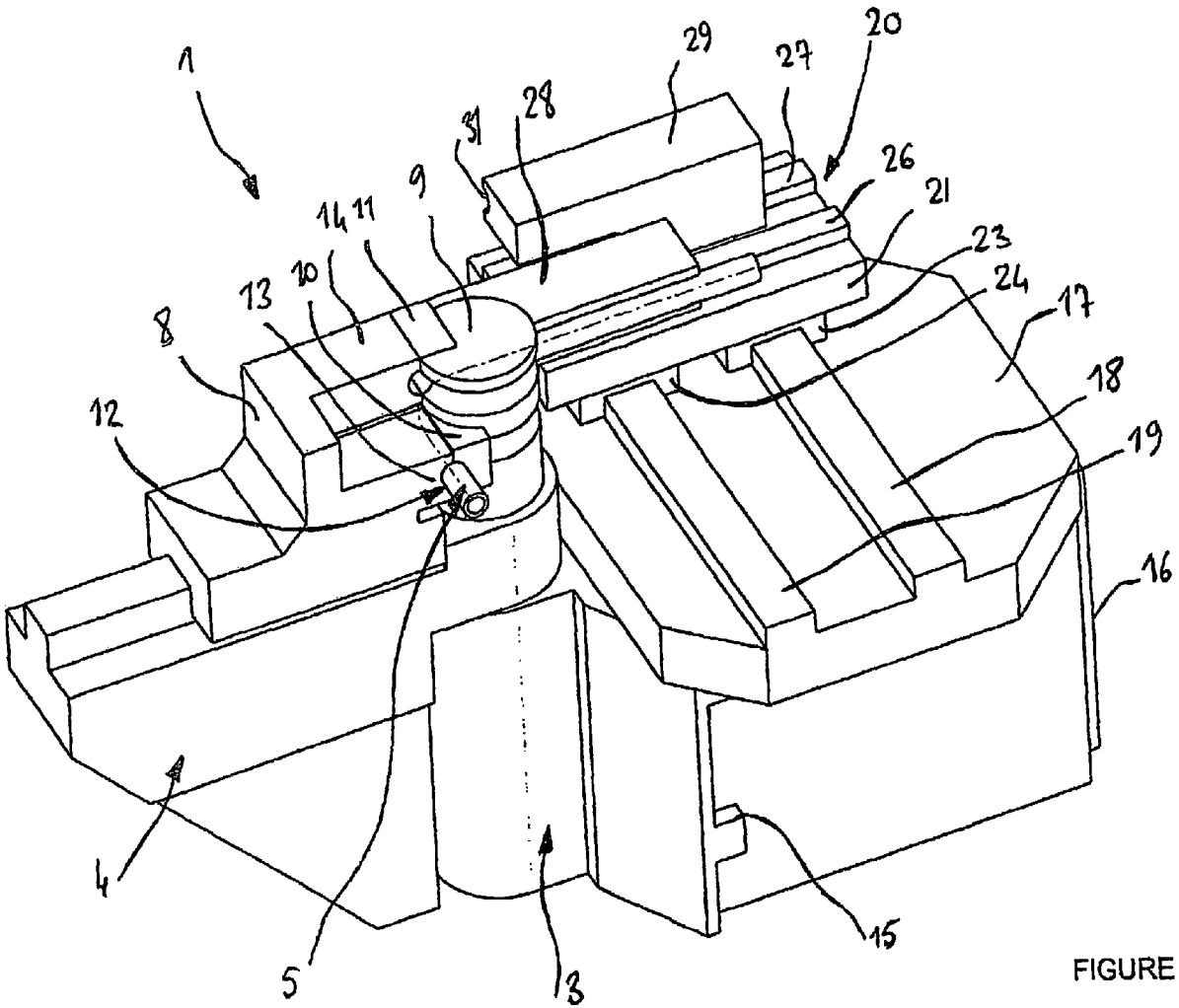

FIG. 5 shows the bending of the tube 5 in a counterclockwise direction by means of pivoting of the bending arm 4 around the bending head 3. The guide 28 provides conveyance of the tube 5 by allowing sliding the tube 5 inside of the recess 30 by the rotation of the jaws 10, 13 of the clamping jaw 12.

Figure 6:
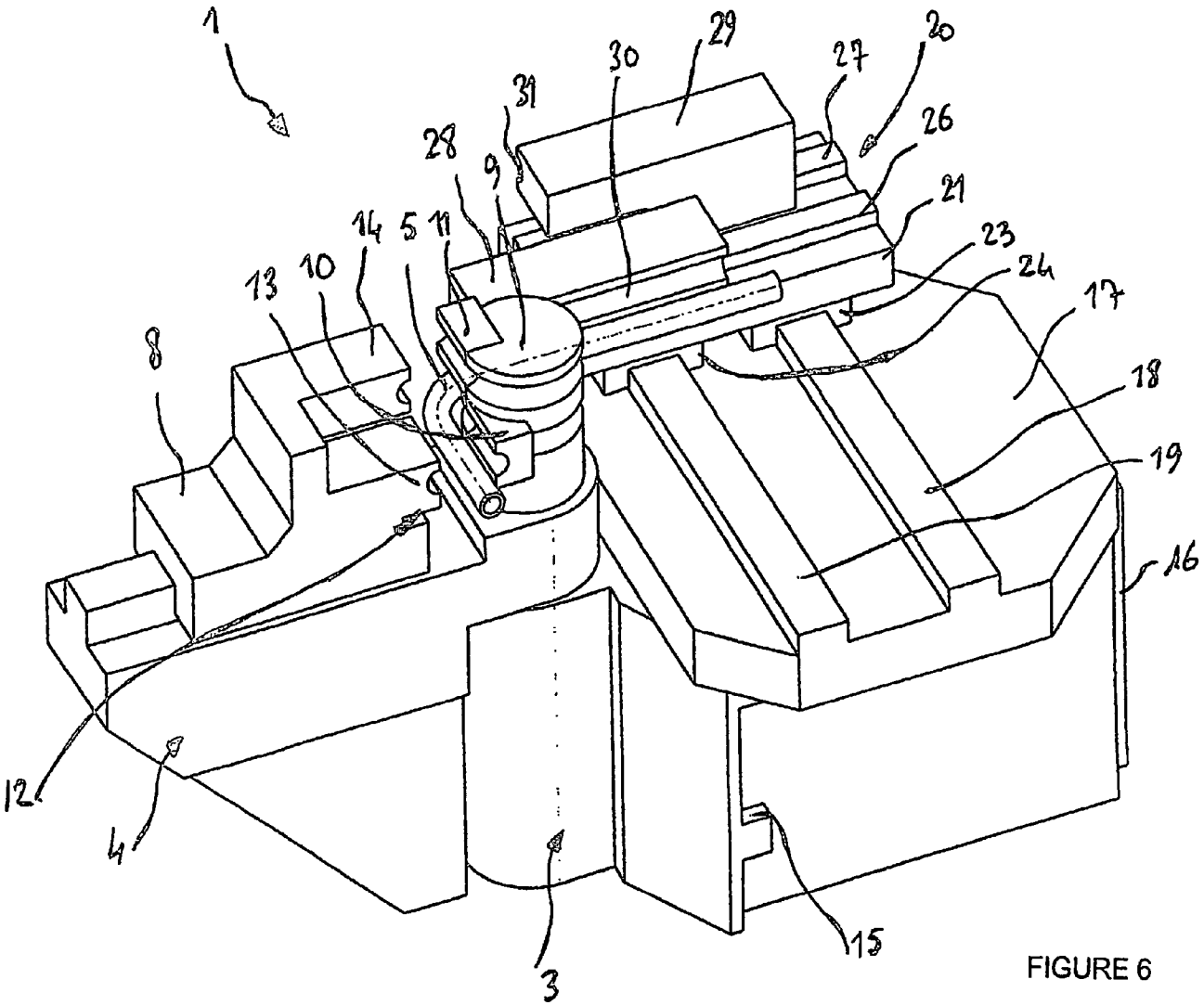

FIG. 6 shows the opening of the clamping jaw 12 by increasing the distance between the jaws 10 and 13 for the release of the bent portion of the tube 5. The opening of the clamping jaw 12 is effectuated by the sliding of the grip support 8 on the bending arm 4 in a tilted position. Next, the guide support 20 travels horizontally on the plate 17 to move the guide 28 in order to release the tube 5 from the recess 30. Lastly, the carriage 6 causes the tube 5 to advance in order to release its bent portion from the jaw 13, which is securely fastened to the bending roller 9.

Figure 7:
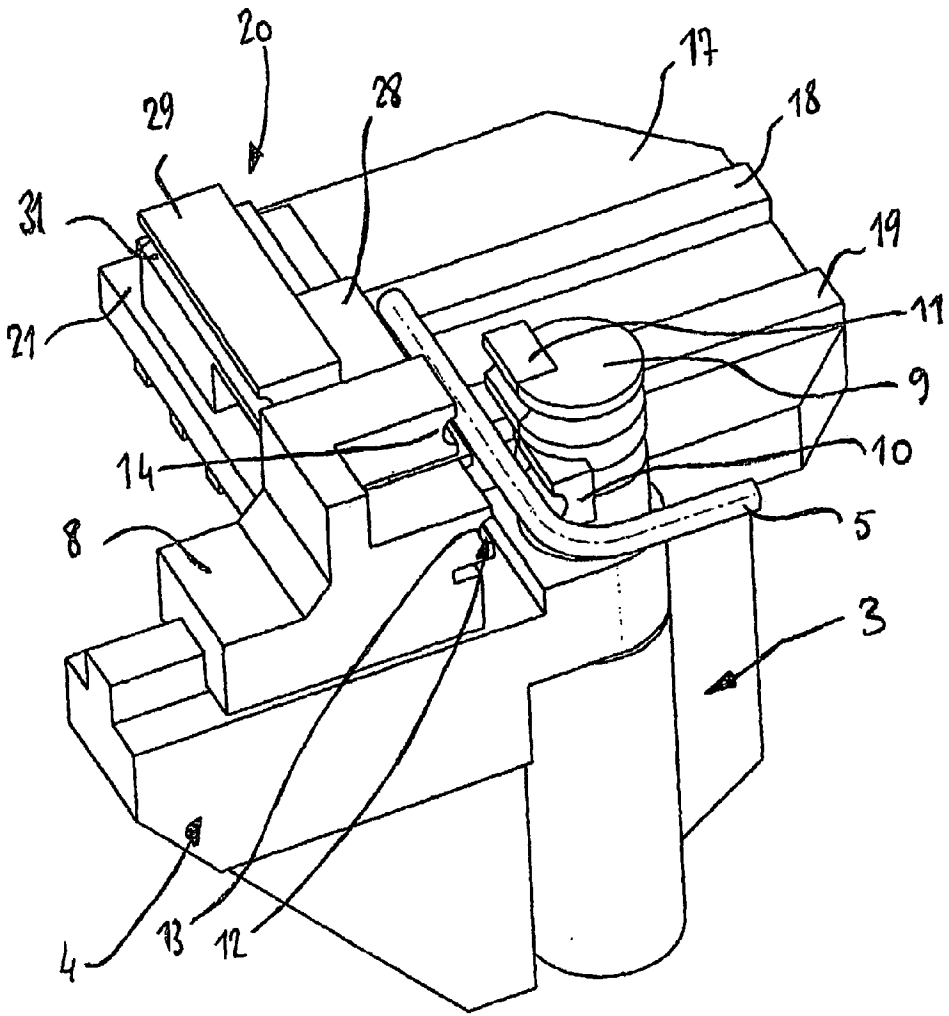

FIG. 7 shows the return of the bending arm 4 to its original position prior to the bending of the tube 5. The return of the bending arm 4 is effectuated with the clamping jaw 12 and the guide support 20 in the same positions described with regard to FIG. 6.

Figure 8:
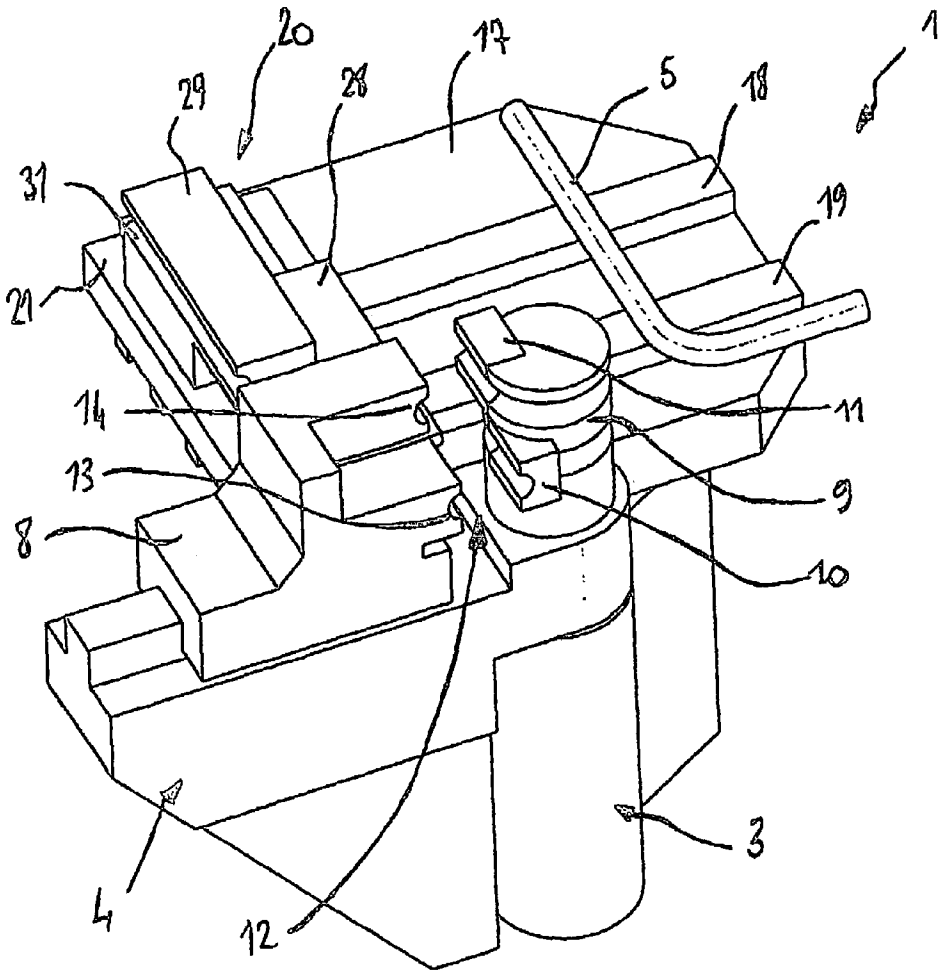
FIGS. 8 to 10 are perspective views showing the different stages of the bending machine in effectuating by means of the guide support, according to the present invention, bending a tube in a clockwise direction, where a bending arm rotates from right to left around the bending head.
Figure 9:
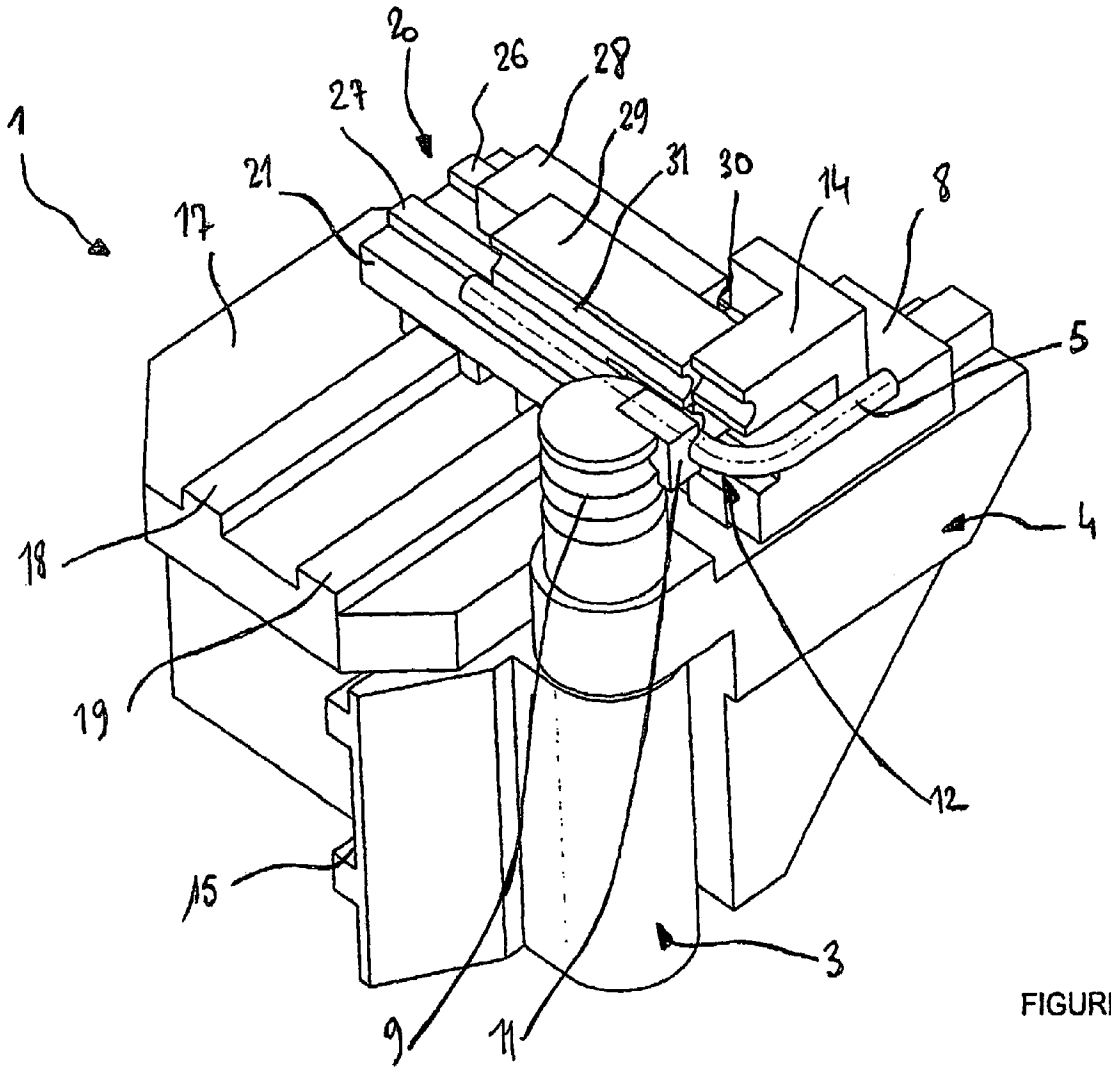
Figure 10:
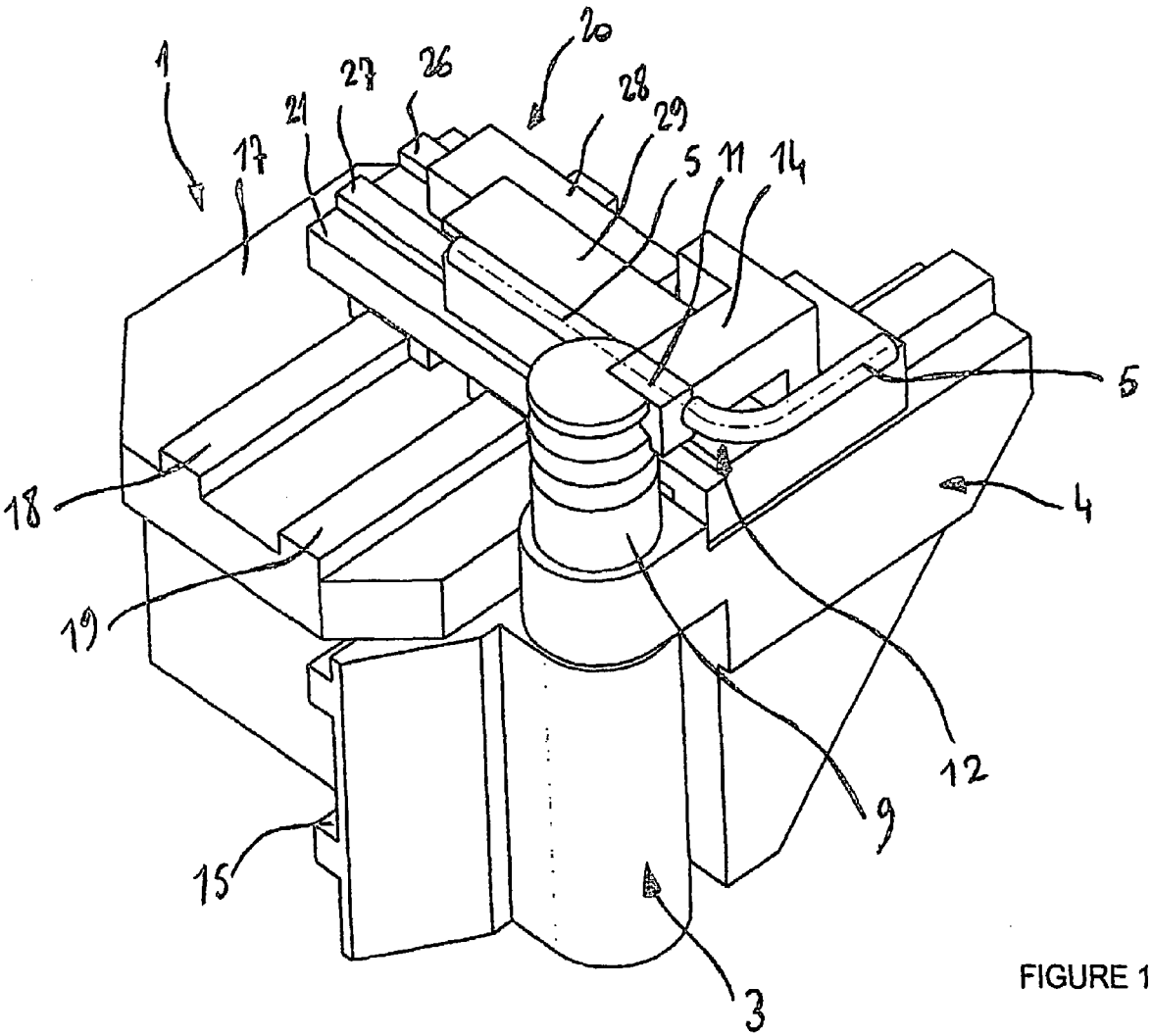

FIGS. 8 to 10 show the various stages of bending the tube 5 in a clockwise direction.

FIGS. 8 and 9 illustrate the release of the already bent tube 5 from the bending zone due to the displacement of the bending head 3.

First, the bending head 3 travels vertically toward a lower part of the bending machine 1 so that the assembly of the bending head 3, the bending arm 4, and the guide support 20 is positioned below the tube 5 held in the carriage 6, which is securely fastened to the framework 2.

Second, the guide support 20 travels horizontally on the plate 17 so that the guide 29 is positioned to the right of the tube 5.

Third and in a simultaneous manner, the bending arm 4 swings around the bending head 3 in order to move the jaw 14 to the right of the tube 5, while the bending arm 3 moves via the sliding means 15 and 16 so as to be positioned at the level of the tube 5, the guide 29, and the jaws 11,14 of the clamping jaw 12.

FIG. 10 shows the position of the tube 5 inside the jaws 11 and 14 of the clamping jaw 12 for carrying out a second bending. The guide 29 of the guide support 20 is in close contact against the tube 5 so that the tube can be lodged in the recess 31.

The second bending of the tube 5 in a clockwise direction is carried out by the swinging of the bending arm 4 around the bending head 3. The guide 29 provides conveyance of the tube 5 by allowing sliding of the tube 5 inside he recess 31 by rotation of the jaws 11, 14 of the clamping jaw 12.

Due to the position between the guides 28 and 29, the guide support 20 allows a standard bending machine 1 to effectuate the bending of a tube 5 in clockwise and counterclockwise directions.

It must be further understood that the foregoing description is given only by way of example and that it does not limit in the least the domain of the invention, which must be observed when substituting the details of embodiment described herein by other equivalent ones.

The invention claimed is:

1. A guide support for a bending machine (1) comprising a framework (2), a bending head (3), a bending arm (4), a bending roller (9), a clamping jaw (12) for the bending of a tube, sliding means (15, 16) for the displacement of the bending head (3) in horizontal and vertical directions with respect to the framework (2), at least two guides (28, 29) carried on a guide element (21) and including recesses (30, 31) arranged in opposite directions with respect to the position of the tube, guiding means (18, 19, 23, 24) for the the guide element (21) on the bending head (3), the guide element (21) being guided in a horizontal translation motion on a plate (17) securely fastened to the bending head (3), the guiding means (18, 19, 23, 24) being positioned adjacent a first surface (22) of the element (21), and the at least two guides (28, 29) being arranged parallel to each other adjacent a second, opposite surface (25) of the element (21).

2. A guide support in accordance with claim 1, wherein the guide element (21) includes rails (26, 27) on the second opposite surface (25), each of which interacts with each of the at least two guides (28, 29).

3. A guide support in accordance with claim 1, wherein the guide (28) includes a recess (30) having an internal profile corresponding to an outer profile of the tube for holding the tube as the tube is bending between jaws (10, 13) of the clamping jaw (12).

4. A guide support in accordance with claim 1, wherein the guide (29) includes a recess (31) having an internal profile corresponding to an outer profile of the tube for holding the tube as the tube is bending between jaws (11, 14) of the clamping jaw (12).

5. A guide support in accordance with claim 2, wherein each of the guides (28, 29) interacts with the rails (26, 27) such that their representative recess (30, 31) is positioned in opposite directions with respect to a horizontal axis of a machine (1) embodied by the tube.

6. A guide support in accordance with claim 1, wherein inverted positions of the guides (28, 29) allow either a bending to the left, or counterclockwise, or to the right, or clockwise on a single bending machine (1).

* * * * *